US011772943B2

(12) United States Patent
Ishida et al.

(10) Patent No.: US 11,772,943 B2
(45) Date of Patent: Oct. 3, 2023

(54) MONITORING DEVICE FOR WINCH DRUM

(71) Applicant: SUMITOMO HEAVY INDUSTRIES CONSTRUCTION CRANES CO., LTD., Tokyo (JP)

(72) Inventors: Daisuke Ishida, Aichi (JP); Tatsuya Matsushita, Aichi (JP)

(73) Assignee: SUMITOMO HEAVY INDUSTRIES CONSTRUCTION CRANES CO., LTD., Tokyo (JP)

( * ) Notice: Subject to any disclaimer, the term of this patent is extended or adjusted under 35 U.S.C. 154(b) by 0 days.

(21) Appl. No.: 17/707,108

(22) Filed: Mar. 29, 2022

(65) Prior Publication Data

US 2022/0306434 A1 Sep. 29, 2022

(30) Foreign Application Priority Data

Mar. 29, 2021 (JP) ..... 2021-055337

(51) Int. Cl.

| | |
|---|---|
| ***B66D 1/50*** | (2006.01) |
| ***B66D 1/54*** | (2006.01) |
| ***B66C 13/16*** | (2006.01) |
| ***B66C 13/46*** | (2006.01) |
| ***B66C 13/48*** | (2006.01) |

(52) U.S. Cl.

CPC ..... *B66D 1/54* (2013.01); *B66C 13/16* (2013.01); *B66C 13/46* (2013.01); *B66C 13/48* (2013.01); *B66D 1/50* (2013.01)

(58) Field of Classification Search

CPC .. B66D 1/485; B66D 1/54; B66D 3/24; B66C 13/16; B66C 13/18; B66C 13/44; B66C 13/48; B66C 13/50

See application file for complete search history.

(56) References Cited

U.S. PATENT DOCUMENTS

| | | | | |
|---|---|---|---|---|
| 2019/0031474 | A1* | 1/2019 | Stilborn | B66D 1/56 |
| 2019/0062127 | A1 | 2/2019 | Hesselbein | |
| 2021/0189645 | A1 | 6/2021 | Mupende et al. | |

FOREIGN PATENT DOCUMENTS

| | | | | |
|---|---|---|---|---|
| CN | 2013-010634 | A | 1/2013 | |
| CN | 103476697 | A * | 12/2013 | B66C 13/16 |
| CN | 106458546 | A * | 2/2017 | B66C 13/16 |
| CN | 208980233 | U | 6/2019 | |
| DE | 10 2018 123 758 | A1 | 1/2020 | |
| JP | H02-056397 | A | 2/1990 | |
| JP | H04-115890 | U | 10/1992 | |
| JP | 2011-001163 | A | 1/2011 | |
| WO | WO-2022191005 | A1 * | 9/2022 | |

OTHER PUBLICATIONS

Search Report issued in European Application No. 22164725.8, dated Aug. 30, 2022.

* cited by examiner

*Primary Examiner* — Emmanuel M Marcelo

(74) *Attorney, Agent, or Firm* — Michael Best & Friedrich LLP

(57) ABSTRACT

Provided is a monitoring device for a winch drum of a crane, the device including: a monitoring unit that monitors whether or not an abrasion generation condition is satisfied for the winch drum; and a notification unit that performs notification based on satisfaction of the abrasion generation condition.

13 Claims, 6 Drawing Sheets

MONITORING DEVICE FOR WINCH DRUM

RELATED APPLICATIONS

The content of Japanese Patent Application No. 2021-055337, on the basis of which priority benefits are claimed in an accompanying application data sheet, is in its entirety incorporated herein by reference.

BACKGROUND

Technical Field

Certain embodiments of the present invention relate to a monitoring device for a winch drum.

Description of Related Art

In a work machine such as a crane that winds and unwinds a wire using a winch drum, in the related art, an image of the winch drum is captured by a camera and a worker is notified of the generation of irregular winding (for example, refer to the related art).

SUMMARY

According to an embodiment of the present invention, there is provided a monitoring device for a winch drum of a crane, the device including: a monitoring unit that monitors whether or not an abrasion generation condition is satisfied for the winch drum; and a notification unit that performs notification based on satisfaction of the abrasion generation condition.

DETAILED DESCRIPTION

However, the monitoring device of the related art merely makes notification of the generation of irregular winding, and cannot inform the worker of the generation of abrasion or the degree of abrasion of the winch drum caused by repeated back-and-forth movements of the wire.

It is desirable to monitor an abrasion state of a winch drum.

According to the present invention, it is possible to effectively monitor an abrasion state of the winch drum.

Outline of Crane

Figure 1:
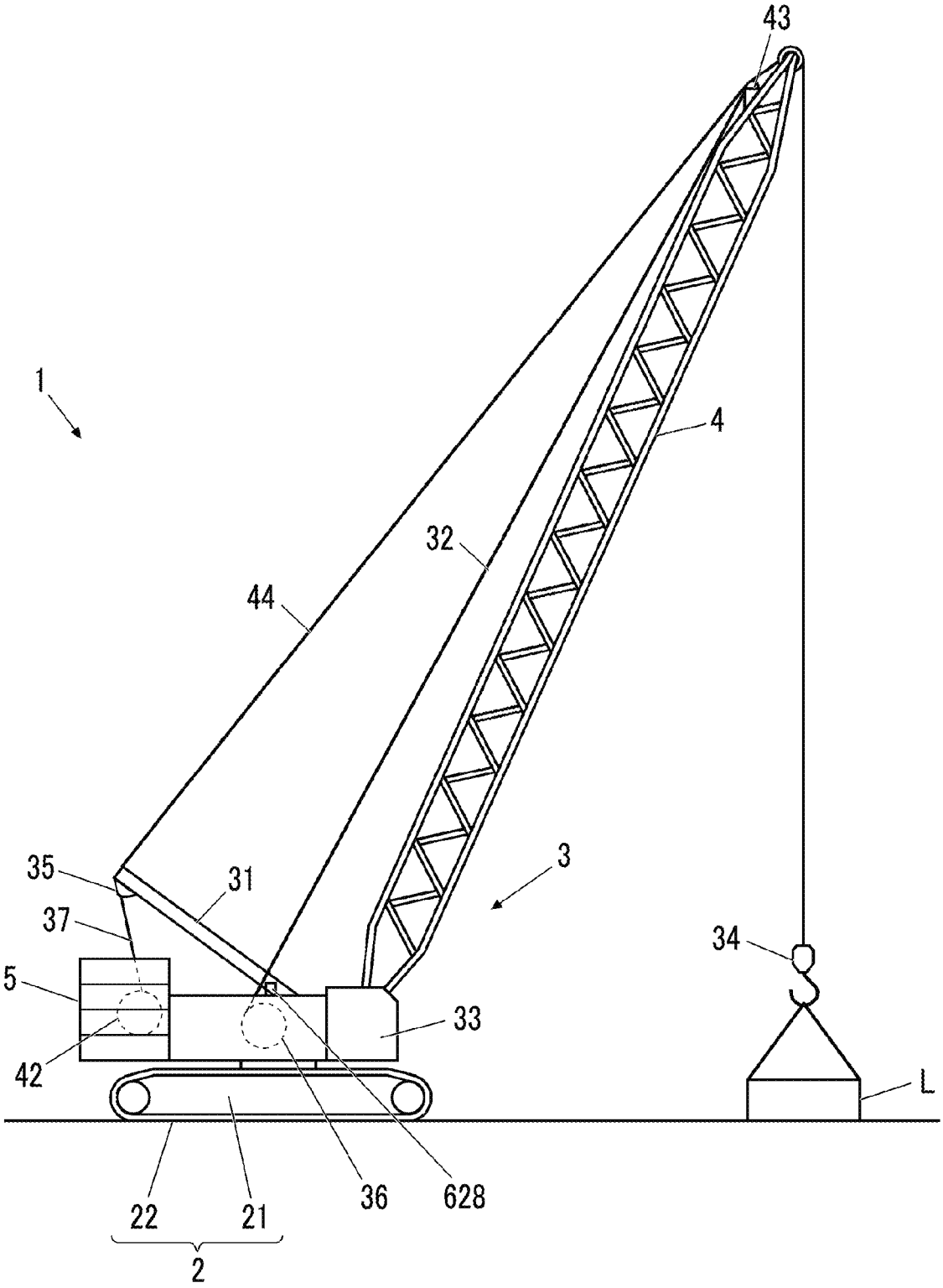
FIG. 1 is a side view of a crane in which a monitoring device for a winch drum according to an embodiment of the present invention is mounted.

FIG. 1 is a side view of a crane as a work machine in which a monitoring device for a winch drum according to an embodiment of the present invention is mounted.

A crane 1 is a so-called mobile crawler crane. In the description of the crane 1, a forward direction of a vehicle is referred to as "front", a backward direction is referred to as "rear, and a left hand side and a right hand side in a state where the vehicle faces the front are referred to as "left" (back side of the drawing sheet of FIG. 1) and "right" (front side of the drawing sheet of FIG. 1), respectively. In addition, a lower traveling body 2 that travels and a rotating platform 3 that turns on the lower traveling body 2 are provided, but unless otherwise specified, in principle, a direction of each part will be described in a state where the lower traveling body 2 and the rotating platform 3 are aligned with each other in a front-back direction (referred to as a reference posture).

As illustrated in FIG. 1, the crane 1 is configured to include the lower traveling body 2 of a crawler type that can travel automatically, the rotating platform 3 that is turnably mounted on the lower traveling body 2, and a boom 4 that is derrickably attached to a front side of the rotating platform 3.

The lower traveling body 2 includes a main body 21 and crawlers 22 provided on both left and right sides of the main body 21. The left and right crawlers 22 each are rotationally driven by traveling hydraulic motors (not illustrated).

The boom 4 is derrickably attached to the front side of the rotating platform 3. A sheave 43 that guides a hoisting rope 32 which is a wire rope is rotatably attached to the vicinity of an upper tip of the boom 4.

In addition, a lower end portion of a mast 31 is supported on a rear side of the boom 4 on the rotating platform 3.

In addition, the rotating platform 3 is driven and turned around an axis along a vertical up-down direction with respect to the lower traveling body 2 by a turning hydraulic motor (not illustrated).

A counterweight 5 that balances the weights of the boom 4 and a suspended load L is attached to a rear portion of the rotating platform 3. The number of the counterweights 5 can be increased or reduced as needed.

A derricking winch 42 that performs a derricking operation of the boom 4 is disposed in the vicinity of the counterweight 5, and a hoisting winch 36 that winds and unwinds the hoisting rope 32 is disposed in front of the derricking winch 42. The hoisting winch 36 is driven by a hoisting hydraulic motor (not illustrated) to wind and unwind the hoisting rope 32, thereby raising and lowering a hook 34 and the suspended load.

In addition, a cab 33 is disposed on a right front side of the rotating platform 3.

The mast 31 includes an upper spreader 35 at an upper end portion of the mast 31, and the upper spreader 35 is connected to the other end portion of a pendant rope 44 of which one end portion is connected to an upper end portion of the boom 4. A lower spreader (not illustrated) is provided below the upper spreader 35, and when a derricking rope 37 that is a wire rope hung between the lower spreader and the upper spreader 35 a plurality of times is wound or unwound by the derricking winch 42, the interval between the upper spreader 35 and the lower spreader is changed, and the boom 4 is derricked. The derricking winch 42 is driven by a derricking hydraulic motor (not illustrated).

Control System for Crane

Figure 2:
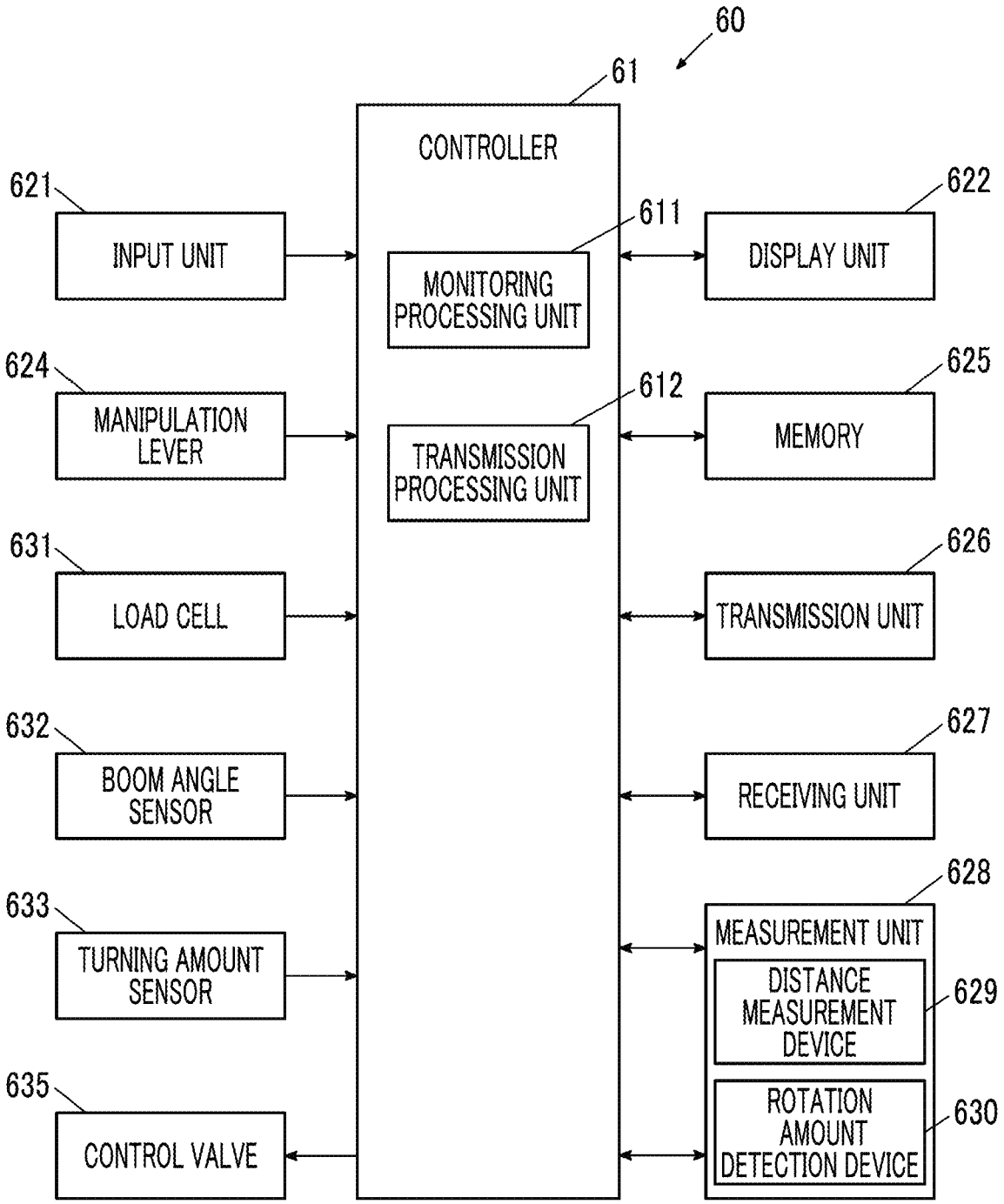
FIG. 2 is a block diagram illustrating a configuration of a control device for the crane and peripherals of the control device.

The control device 60 for the crane 1 is provided in the cab 33 of the rotating platform 3. FIG. 2 is a block diagram illustrating a configuration of the control device 60 and peripherals of the control device 60. The control device 60 is a control terminal mounted in the crane 1, and performs a monitoring process on winding and unwinding of the hoisting rope 32 by the hoisting winch 36, in addition to controlling various operations such as traveling and turning of the crane 1 and winding and unwinding of the hoisting rope 32.

The control device 60 includes a controller 61 configured to include a calculation processing device including a CPU, a ROM and a RAM that are storage devices, other peripheral circuits, and the like.

The controller 61 includes software modules such as a monitoring processing unit 611 that performs the monitoring process on winding and unwinding of the hoisting rope 32, and a transmission processing unit 612 that outputs operation information of the crane to the outside, which will be described later. Incidentally, the monitoring processing unit 611 and the transmission processing unit 612 may be configured as hardware.

An input unit 621, a display unit 622, a manipulation lever 624, a memory 625, a transmission unit 626, and a receiving unit 627 are connected to the controller 61, and these components form the control device 60.

Further, a load cell 631, a boom angle sensor 632, a turning amount sensor 633, a control valve 635, and a measurement unit 628 are connected to the controller 61.

The monitoring processing unit 611 and the measurement unit 628 function as a monitoring unit that monitors whether or not an abrasion generation condition determined in advance for a winch drum 361 of the hoisting winch 36 is satisfied. In addition, the monitoring unit and the transmission processing unit 612 form a monitoring device for the winch drum.

Details of a function of each of the monitoring processing unit 611 and the transmission processing unit 612 will be described later.

The input unit 621 is provided in the cab 33, is, for example, an input interface such as a touch panel, and outputs a control signal corresponding to a manipulation from a worker to the controller 61. The worker can manipulate the input unit 621 to input a length of the boom 4, a weight of the suspended load, various other settings, or various information required for operation.

Figure 4:
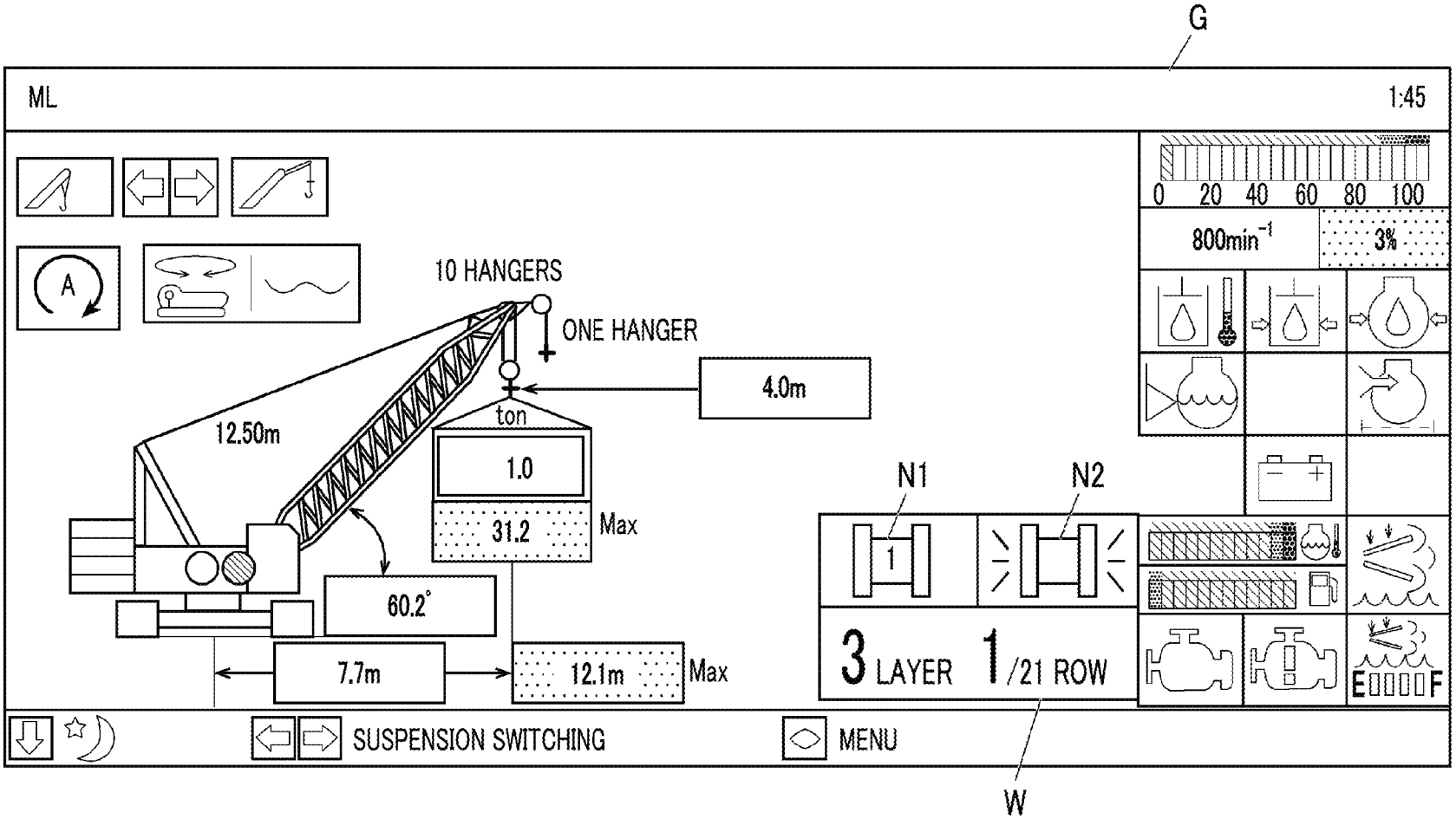
FIG. 4 is a display example of a screen that displays operation information such as various set values, detected values, and the like in the crane.

The display unit 622 is provided in the cab 33, includes, for example, a touch panel type display that is also used as the input unit 621, and displays information such as the weight of the suspended load, a boom angle, and a turning angle of the rotating platform 3 on a display screen based on a control signal output from the controller 61 (refer to FIG. 4). In addition, the display unit 622 functions as a notification unit that performs notification by display according to the monitoring processing unit 611 to be described later.

The manipulation lever 624 is provided in the cab 33, for example, manually inputs a manipulation to cause the crane 1 to perform various operations, and inputs a control signal corresponding to a manipulated variable of the manipulation lever 624 to the controller 61.

For example, the manipulation lever 624 can input a manipulation for a traveling operation of the lower traveling body 2, a turning operation of the rotating platform 3, a derricking operation of the boom 4, or winding and unwinding of the hoisting rope 32 by the hoisting winch 36.

The transmission unit 626 and the receiving unit 627 are wireless communication devices, perform wireless transmission and reception with an external communication base station 150 (refer to FIG. 6) to be described later, and perform information communication with an external communication network via the communication base station 150.

The load cell 631 is attached to the upper spreader 35, and detects a tension acting on the pendant rope 44 that derricks the boom 4, to output a control signal corresponding to the detected tension to the controller 61.

The boom angle sensor 632 is attached to a base end side of the boom 4, and detects a derricking angle of the boom 4 (hereinafter, also referred to as a boom angle) to output a control signal corresponding to the detected boom angle to the controller 61. The boom angle sensor 632 detects, for example, a ground angle that is an angle with respect to a horizontal plane, as a boom angle.

The turning amount sensor 633 is attached between the lower traveling body 2 and the rotating platform 3, and detects a turning angle of the rotating platform 3 to output a control signal corresponding to the detected turning angle to the controller 61. The turning amount sensor 633 detects, for example, an angle around a vertical axis as a turning angle.

The control valve 635 includes a plurality of valves that can be switched according to a control signal from the controller 61.

For example, the control valve 635 includes a valve that controls the rotational drive of the left and right crawlers 22 of the lower traveling body 2, a valve that controls a turning operation of the rotating platform 3, a valve that controls the rotational drive of the derricking winch 42, a valve that controls the rotational drive of the hoisting winch 36, and the like.

Figure 3:
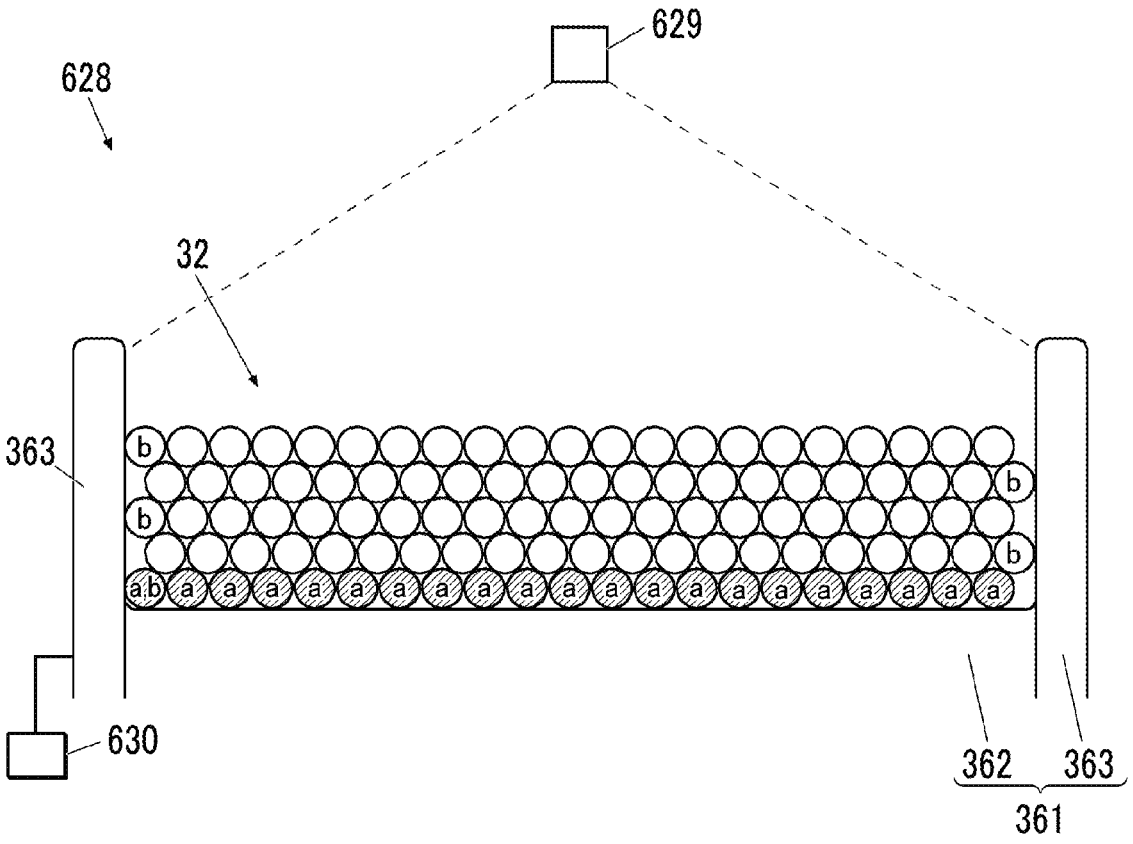
FIG. 3 is a descriptive view illustrating a specific mode of a measurement unit.

The measurement unit 628 detects a layer and row state of the hoisting rope 32 wound around the winch drum 361 of the hoisting winch 36. FIG. 3 is a descriptive view illustrating a specific mode of the measurement unit 628.

The layer and row state of the hoisting rope 32 indicates the number of layers of and the number of rows of the hoisting rope 32 that is layered and wound around the winch drum 361 in a layered manner.

Incidentally, a portion of the hoisting rope 32 in a position away from a winding portion 362 of the winch drum 361 around which the hoisting rope 32 is wound is referred to as an "unwound portion of the wire rope". Therefore, the layer and row state of the hoisting rope 32 indicates a layer and a row where the unwound portion of the hoisting rope 32 is located.

Namely, as illustrated in FIG. 3, the winch drum 361 includes the winding portion 362 around which the hoisting rope 32 is wound, and two drum flanges 363 each having a brim shape which are provided at both end portions of the winding portion 362. Then, the hoisting rope 32 is sequentially wound around the winding portion 362 of the winch drum 361 from one drum flange 363 side to the other drum flange 363 side, and winding is repeated such that the hoisting rope 32 is layered to form layers. Namely, the number of layers up to an outermost side of layers of the hoisting rope 32 is the "number of layers" in the "layer and row state". In addition, the number of turns of the hoisting rope 32 wound from an end in a layer on the outermost side is the "number of rows" in the layer and row state".

Incidentally, when the hoisting rope 32 is wound around the winch drum 361, the hoisting rope 32 is wound in one layer from the one drum flange 363 side to the other drum flange 363 side, in a next layer, the hoisting rope 32 is folded back and wound in one layer from the other drum flange 363 side to the one drum flange 363 side, and the windings are alternately repeated, so that the hoisting rope 32 of many layers is wound in many layers.

Therefore, in an odd-numbered layer of the hoisting rope 32, a first row is on the one drum flange 363 side (left drum flange 363 in the example of FIG. 3), and in an even-numbered layer, a first row is on the other drum flange 363 side (right drum flange 363 in the example of FIG. 3).

The measurement unit 628 performs detection on the winch drum 361 around which the hoisting rope 32 is wound in such a manner, for example, with a distance measurement device 629 of a laser beam scanning type such as a LiDAR and a rotation amount detection device 630 such as a potentiometer that detects a rotation amount (rotation angle) of the winch drum 361.

Incidentally, the distance measurement device 629 is not limited to the laser beam scanning type such as a LiDAR, and it is also possible to use other sensor, other camera, or the like capable of detecting a distance to the hoisting rope 32 that is wound.

Similarly, the rotation amount detection device 630 is not limited to the potentiometer, and it is possible to use any sensor capable of detecting a rotation amount of the winch drum 361.

As illustrated in FIG. 3, the distance measurement device 629 scans a plane including a center axis of the winch drum 361 with laser from a radially outer side toward a radially inner side of the winch drum 361 to measure a distance to the hoisting rope 32 exposed to a surface side between the one drum flange 363 and the other drum flange 363. From the measurement result, an axial cross-sectional shape of the winch drum 361 can be measured, and a layer and row state of the hoisting rope 32 wound around the winch drum 361 can be detected.

For example, as illustrated in FIG. 3, when the hoisting rope 32 is wound to the end in an outermost layer, the distance measurement device 629 can obtain the measurement result that a distance from the distance measurement device 629 to a surface of the hoisting rope 32 is substantially uniform between the one drum flange 363 and the other drum flange 363.

Therefore, from the measurement result, the number of layers of the hoisting rope 32 can be obtained from the distance from the distance measurement device 629 to the surface of the hoisting rope 32 that is wound.

In addition, since the obtained distance is substantially uniform, it is possible to obtain the fact that the hoisting rope 32 is wound exactly to the end (the number of rows in one layer is its maximum).

In addition, in a case where the hoisting rope 32 is halfway wound in the outermost layer, when the distance measurement device 629 measures a distance the distance measurement device 629 to the surface of the hoisting rope 32 between the one drum flange 363 and the other drum flange 363, the result that a step is generated in the middle can be obtained.

Therefore, from the measurement result, the number of layers of the hoisting rope 32 can be obtained from the distances from the distance measurement device 629 to the surface of the hoisting rope 32 that is wound (shorter one of the distances between which the step is interposed).

In addition, the number of rows can be obtained by dividing a distance from the one or the other drum flange 363 to the step by a width (outer diameter) of the hoisting rope 32.

In addition, although details will be described later, the monitoring processing unit 611 performs a process of integrating a total amount of a winding amount where winding is performed by work and an unwinding amount where unwinding is performed (length of the hoisting rope), in a specific layer or row of the hoisting rope 32.

The rotation amount detection device 630 can detect a rotation amount (amount of a change in rotation angle) of the winch drum 361 from an origin. Accordingly, a winding amount or an unwinding amount for the specific number of layers of or the specific number of rows of the hoisting rope 32 can be obtained.

Monitoring Process for Winch Drum

The monitoring processing unit 611 monitors whether or not an abrasion generation condition determined in advance for the winch drum 361 is satisfied, in cooperation with the measurement unit 628 described above.

In the winch drum 361, a portion where the hoisting rope 32 is rubbed and abrasion is likely to be generated in a winding and unwinding operation is determined.

As illustrated in FIG. 3, in the case of a row a of one layer (innermost layer), when the hoisting rope 32 is wound or unwound, the hoisting rope 32 is directly rubbed against an outer peripheral surface of the winding portion 362 of the winch drum 361, and abrasion is likely to be generated.

In addition, when the hoisting rope 32 is wound or unwound in the position of the drum flange of the winch drum 361, namely, in a first row (referred to as a row b) of each of all layers (including a first layer), the hoisting rope 32 is directly rubbed against the drum flange 363, and abrasion is likely to be generated.

Therefore, when the hoisting rope 32 is wound or unwound around the winch drum 361 in the first layer (innermost layer), the monitoring processing unit 611 determines that the abrasion generation condition is satisfied.

In addition, the monitoring processing unit 611 determines a condition related to a flange adjacent movement amount that is an amount of movement by which the hoisting rope 32 moves in a position adjacent to the drum flange 363, as the abrasion generation condition. More specifically, when a ratio of an integrated value of the amount of movement (a winding length and an unwinding length) of the hoisting rope 32 in the row b of each layer (flange adjacent movement amount) to an integrated value of an overall winding length and an overall unwinding length of the winch drum 361 (total amount of movement of the hoisting rope 32) is more than a certain value (threshold), it is determined that the abrasion generation condition is satisfied. Incidentally, in this case, integration is individually performed for each row b of each layer, and it is determined whether or not each integrated value is more than the threshold. In addition, integration is not distinguished between a winding direction and an unwinding direction, and absolute values of the winding length and the unwinding length are integrated.

The abrasion generation condition (condition related to the flange adjacent movement amount that is an amount of movement of the hoisting rope 32 in the row b of each layer) is not limited to the condition where the ratio of the flange adjacent movement amount to the total amount of movement of the hoisting rope 32 is more than the threshold, and may be a condition where a ratio of the flange adjacent movement amount for a certain period or to a certain amount of movement is more than the threshold.

Then, when one of the abrasion generation conditions is satisfied, the monitoring processing unit 611 executes a notification process. In the notification process, for example, a notification icon is displayed on the display unit 622 to cause the worker to recognize the generation of abrasion of the winch drum 361.

FIG. 4 illustrates one example of a display screen G of the display unit 622 which displays operation information such as various set values or detected values in the crane 1. The display screen G is constantly displayed when the crane 1 is used.

A first icon N1 indicating an abrasion generation condition when winding or unwinding is performed in the first layer, and a second icon N2 indicating the abrasion generation condition when an integrated value of a winding length and an unwinding length in the first row is more than the threshold are displayed within two frames specified in the display screen G.

The first icon N1 resembles the winch drum 361, and the number "1" indicating the first layer is written in the icon.

The second icon N2 resembles the winch drum 361, and the state of rubbing against the drum flange 363 is displayed on the icon.

A method for displaying each of the icons N1 and N2 is not limited to a method where displaying is performed only when the abrasion generation condition is satisfied. For example, any display method that enables satisfaction of the abrasion generation condition to be visually recognizable may be performed, such as a method in which each of the icons N1 and N2 is normally displayed, and when the abrasion generation condition is satisfied, the icon or the background is brightened or changed in color, the icon blinks, or the icon is enlarged.

In addition, a layer and row information display portion W is provided below display frames of the icons N1 and N2 in the display screen G, the layer and row information display portion W displaying layer and row information indicating a layer and a row where an unwound portion of the hoisting rope 32 wound or unwound around the winch drum 361 is currently located, regardless of whether or not the abrasion generation condition is satisfied. The layer and row information display portion W also displays the total number of rows to be wound in one layer, adjacent to the number of the row based on measurement.

Incidentally, the notification process is not limited to display by the display unit 622, and it is also possible to use any means recognizable by the worker, such as display by a notification lamp or a voice output by a voice output unit.

Figure 5:
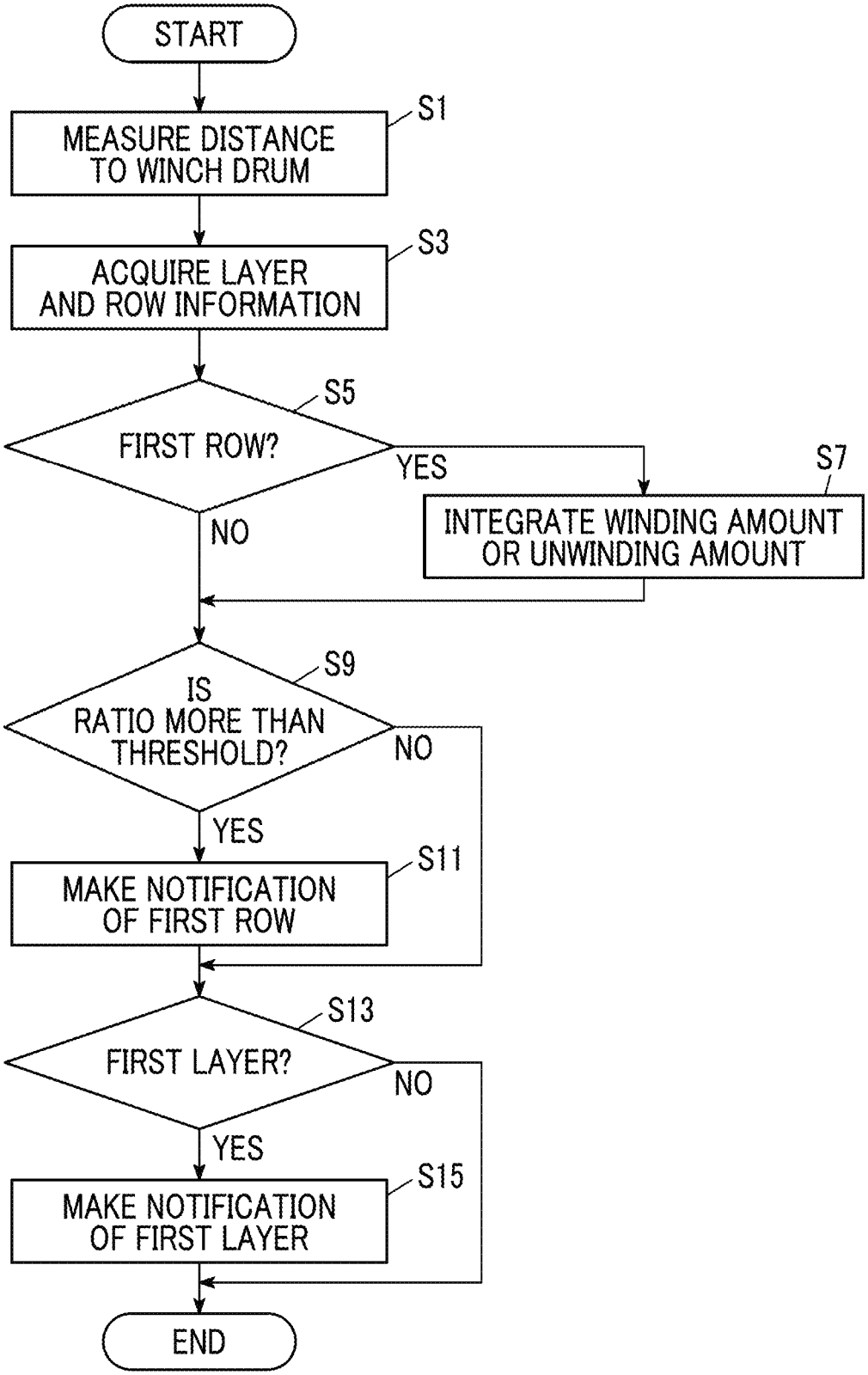
FIG. 5 is a flowchart illustrating a monitoring process to be performed by a monitoring processing unit.

FIG. 5 is a flowchart illustrating the monitoring process to be performed by the monitoring processing unit 611. The monitoring process will be specifically described based on the flowchart. Incidentally, a process of the flowchart is repeatedly executed at a very small cycle time determined in advance by the monitoring processing unit 611.

The monitoring processing unit 611 controls the distance measurement device 629 to measure a distance to the winch drum 361 via laser scanning (step S1). Then, current layer and row information of the hoisting rope 32 that is wound around the winch drum 361 is acquired based on the measurement result (step S3).

Further, from the layer and row information, it is determined whether or not the hoisting rope 32 is currently wound or unwound around the winch drum 361 in the first row of any layer (step S5).

As a result, in step S5, when it is determined that the hoisting rope 32 is wound or unwound in the first row, the monitoring processing unit 611 causes the rotation amount detection device 630 to integrate a winding amount and an unwinding amount of the hoisting rope 32 in the first row (step S7), and the process proceeds to step S9.

Incidentally, as described above, since the monitoring process is repeatedly executed at the very small cycle time determined in advance, the amount of a change is obtained from detection of the rotation amount detection device 630 in a previous monitoring process, and an absolute value of the amount of a change is integrated. In addition, since an integrated value is individually obtained for each layer, the integrated value in step S7 is added to the integrated value for the corresponding layer.

On the other hand, when it is determined that the hoisting rope 32 is not wound or unwound in the first row, or after the integrated value in step S7 is added, the monitoring processing unit 611 determines whether or not the current ratio of the integrated value of the winding amount or the unwinding amount of the hoisting rope 32 in the first row (flange adjacent movement amount) to the total amount of movement of the hoisting rope 32 is more than the threshold (step S9).

As a result, when it is determined that the ratio of the integrated value of the winding amount and the unwinding amount is the threshold or less, the process proceeds to step S13, and it is determined whether or not the hoisting rope 32 is wound or unwound in the first layer.

On the other hand, when it is determined that the integrated value of the winding amount and the unwinding amount is more than the threshold, the notification process is executed, and the second icon N2 is displayed on the display unit 622 (step S11).

Next, the monitoring processing unit 611 determines whether or not the hoisting rope 32 is currently wound or unwound around the winch drum 361 in the first layer, from the layer and row information (step S13).

As a result, when it is determined that the hoisting rope 32 is not wound or unwound in the first layer, the monitoring process ends, and when it is determined that the hoisting rope 32 is wound or unwound in the first layer, the notification process is executed, and the first icon N1 is displayed on the display unit 622 (step S15).

Then, the monitoring process ends.

Transmission Process

A transmission processing to be performed by the transmission processing unit 612 will be described. The transmission processing unit 612 controls the transmission unit 626 described above to transmit and output operation information of the crane 1 to the outside of the crane 1.

For example, the transmission processing unit 612 periodically outputs operation information to the outside. For example, one day is provided as an example of the cycle, but the cycle is not limited thereto, and can be arbitrarily increased or reduced. In addition, the cycle may be arbitrarily set.

The operation information of the crane 1 output to the outside by the transmission processing unit 612 includes, for example, information regarding the monitoring process, information regarding work conditions of the crane 1, information regarding work contents of the crane 1, and the like.

The information regarding the monitoring process (information regarding the abrasion generation condition) includes, for example, the following items accumulated within one period of the output cycle (one day in the above example), namely, (1) the frequency of notifications on winding or unwinding in the first layer, (2) an execution time of the notification, (3) an integrated value of a winding amount and an unwinding amount during the execution time of the notification (period where the abrasion generation condition is satisfied), (4) the frequency of notifications on winding or unwinding in the first row, (5) an execution time of the notification, (6) an integrated value of a winding amount and an unwinding amount during the execution time of the notification (period where the abrasion generation condition is satisfied), and the like.

In addition, regarding the above information, the numerical value range of a line pull in the crane 1 to be described later may be divided into a plurality of sections, and a numerical value of each of the items (1) to (6) may be obtained for each section of the line pull and used as information regarding the monitoring process. Accordingly, it is possible to obtain information indicating a distribution of the size of the line pull when notification on winding or unwinding in the first layer is generated or when notification winding or unwinding in the first row is generated (period where the abrasion generation condition is satisfied).

In addition, regarding the items (4) to (6) within one period of the output cycle, a numerical value of each item may be obtained for each layer and used as information regarding the monitoring process.

Examples of the information regarding the work conditions of the crane 1 include the length of the boom 4, the number of hangers of the hoisting rope 32, and the like.

Examples of the information regarding the work contents of the crane 1 include a maximum line pull value, a maximum working radius, and the like recorded by the crane 1. The line pull is a value obtained by dividing a load applied to the hoisting rope 32 by the number of hangers of the hoisting rope 32. In addition, the maximum working radius is a maximum radius in a plan view obtained from the length of the boom and an inclination angle of the boom during work. The above values are also information related to a frictional force between the wire rope and the drum.

The transmission processing unit 612 accumulates the operation information including the above items during one period (one day in the above example) of the output cycle, and outputs the operation information to the outside in accordance with the advent of the output cycle.

Figure 6:
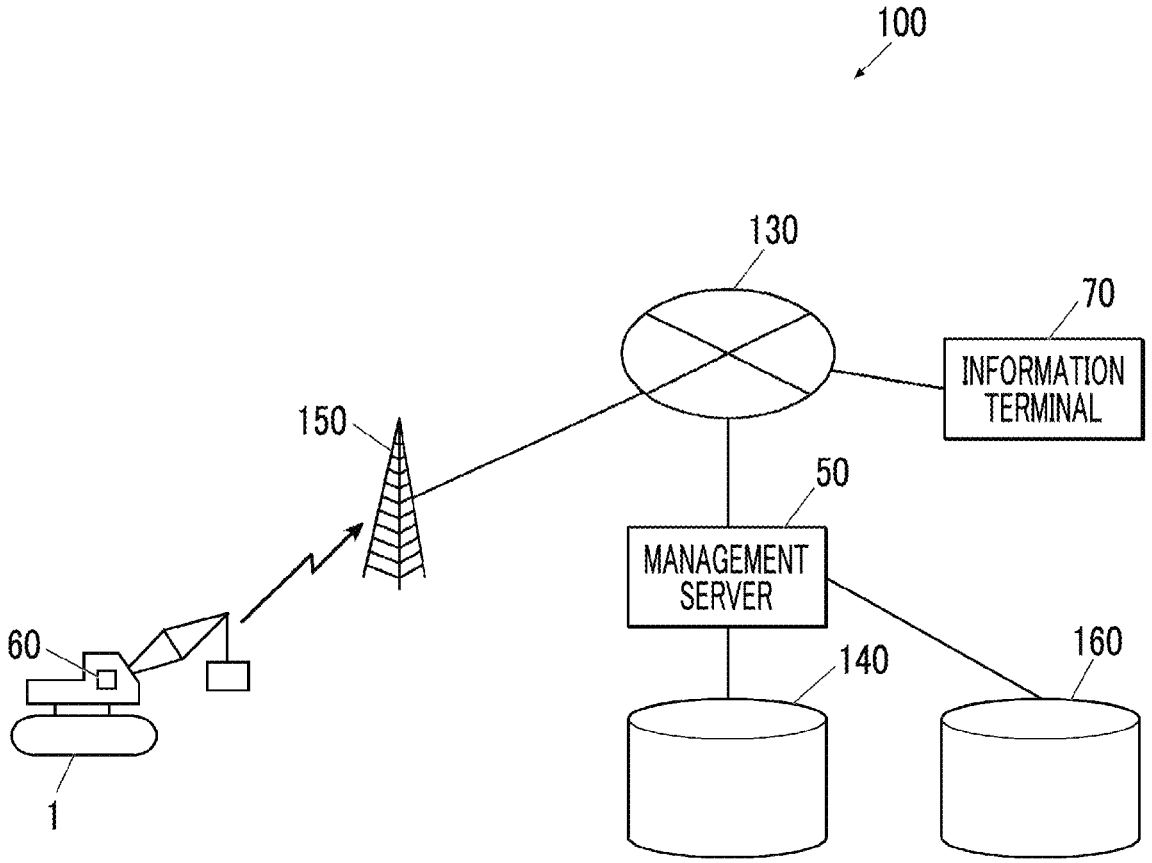
FIG. 6 is a block diagram illustrating a configuration of an information management system for the crane.

FIG. 6 is a block diagram illustrating a configuration of an information management system 100 for the crane 1. As illustrated in FIG. 6, the information management system 100 includes the control device 60 for the crane 1, an external information terminal 70, and a management server 50.

The management server 50 is connected to a network 130 such as a general public network.

In addition to the management server 50, the communication base station 150, the information terminal 70, and the like are connected to the network 130. The management server 50 can exchange data with the communication base station 150, the control device 60 for the crane 1, and the external information terminal 70 that are connected to the network 130.

The communication base station 150 is, for example, a base station for mobile phone communication lines. When the communication base station 150 receives operation information data of the crane 1 that is output to the outside through the transmission unit 626 by the transmission processing unit 612 of the control device 60 for the crane 1, the communication base station 150 transmits the operation information data to the management server 50 via the network 130.

An operation information database 140 for the crane and an information provision destination database 160 in which an operation information provision destination is recorded are connected to the management server 50. The management server 50 stores the operation information data received from the control device 60 for the crane 1, in the operation information database 140.

In addition, the management server 50 transmits the operation information data stored in the operation information database 140, to the information terminal 70 via the network 130. The management server 50 determines an information transmission destination based on contents of the information provision destination database 160.

The transmission of the operation information data may be performed only when there is a request from an information terminal 70 side.

In such a manner, the operation information data output to the outside by the transmission processing unit 612 of the control device 60 for the crane 1 is provided to a manager or the like who uses the external information terminal 70.

Incidentally, the information management system 100 that provides the operation information data is one example, and is not limited to the above configuration. For example, the management server 50 may be omitted, and the operation information data may be directly provided to the information terminal 70 registered in advance, through the network 130.

Technical Effects of Embodiment of Invention

As described above, the controller 61 of the control device 60 for the crane 1 includes the monitoring processing unit 611 that monitors whether or not the abrasion generation condition is satisfied for the winch drum 361, and the display unit 622 that performs notification based on satisfaction of the abrasion generation condition.

For this reason, it is possible to cause the worker to clearly recognize a situation of generation of abrasion that can be generated in the winch drum 361 by the hoisting rope 32.

Incidentally, in the embodiment, a certain condition of which contents do not change is provided as an example of the abrasion generation condition, but the abrasion generation condition may employ an enhanced learning function, gradually carry out learning, and be automatically updated.

In addition, since the monitoring processing unit 611 monitors a layer and row state of the hoisting rope 32 wound around the winch drum 361, even when abrasion generated in the winch drum 361 is not directly measured, it is possible to more easily recognize a situation of generation of abrasion that can be generated by the hoisting rope 32.

Incidentally, the abrasion generation condition is not limited to a condition where the generation of abrasion is expected, as provided as an example in the embodiment, and may be, for example, a condition where an abrasion amount of the hoisting rope 32 on the winch drum 361 is directly measured and the generation of abrasion is determined from a measured value.

In addition, since the abrasion generation condition to be determined by the monitoring processing unit 611 includes a condition that is satisfied when the first layer of the hoisting rope 32 wound around the winch drum 361 is used, even when abrasion generated in the winch drum 361 is not directly measured, it is possible to predictively detect abrasion to be generated at an outer periphery of the winding portion 362 of the winch drum 361, and cause the worker of the abrasion.

In addition, since another abrasion generation condition to be determined by the monitoring processing unit 611 is the condition related to the flange adjacent movement amount that is an amount of movement by which the hoisting rope 32 moves in a position adjacent to the drum flange 363, even when abrasion generated in the winch drum 361 is not directly measured, it is possible to predictively detect abrasion to be generated in the drum flange 363 of the winch drum 361, and cause the worker of the abrasion.

Incidentally, the condition related to the flange adjacent movement amount is not limited to the example provided in the embodiment, and may be a condition where a ratio of the flange adjacent movement amount for a certain period or to a certain amount of movement is more than the threshold, or a condition where the total amount of the flange adjacent movement amount is more than the threshold.

In addition, since the controller 61 includes the transmission processing unit 612 that accumulates operation information of the crane including a movement distance of the hoisting rope 32 or a notification time during a period where the abrasion generation condition of the winch drum 361 is satisfied, and information indicating a distribution of the size of the line pull, it is possible to later analyze a situation of the crane 1 when the abrasion generation condition is satisfied, and take measures against the generation of abrasion.

In addition, since the transmission processing unit 612 divides operation information of the crane into a plurality of sections, and accumulates information related to the abrasion generation condition for each section of the operation information, a situation of the crane 1 when the abrasion generation condition is satisfied can be analyzed in more detail.

Specifically, when the condition related to the flange adjacent movement amount is set as the abrasion generation condition, the numerical value range of the line pull as load information regarding a load acting on the hoisting rope 32 is divided into a plurality of sections, and the flange adjacent movement amount is accumulated for each section of the load information. For this reason, the size of the line pull when abrasion is generated by movement adjacent to the flange can be identified, and a situation of the crane 1 when the abrasion generation condition is satisfied can be analyzed in more detail.

Incidentally, the line pull is provided as an example of a load acting on the hoisting rope 32, but the line pull can also be called a load acting on the drum, and "the load acting on the hoisting rope (wire rope)" also includes the load acting on the winch drum.

In addition, as in the embodiment, the invention is not limited to the case of dividing by the numerical value of the line pull, and the flange adjacent movement amount may be accumulated for each of work of the crane, load suspending work, excavation work, and the like.

In addition, since the transmission processing unit 612 outputs accumulated operation information of the crane to the outside of the crane, not only the worker who operates the crane 1 but also a manage outside or the like are allowed to analyze a situation of the crane 1 when the abrasion generation condition is satisfied, or take measures against the generation of abrasion.

In addition, the monitoring processing unit 611 causes the display unit 622 to display an indication of satisfaction of the abrasion generation condition on the display screen, together with a layer and row display indicating a layer and a row where an unwound portion of the hoisting rope 32 wound around the winch drum 361 is located. Therefore, it is possible to cause the worker to recognize the generation of abrasion and the position of the unwound portion in association with each other.

In addition, when the unwound portion of the hoisting rope 32 is located in the first layer, separately from a layer and row display, the monitoring processing unit 611 causes the display unit 622 to display an indication of the unwound portion being located in the first layer, with the first icon N1.

Therefore, it is possible to cause the worker to clearly recognize the generation of abrasion caused by the use of the first layer.

Others

The detailed parts described in the embodiment of the invention can be appropriately changed without departing from the concept of the invention.

For example, the measurement unit 628 is configured to include the distance measurement device 629 and the rotation amount detection device 630, but is not limited thereto.

For example, the configuration may be such that the rotation amount detection device 630 is omitted from the measurement unit 628. The distance measurement device 629 can easily acquire layer and row information of the hoisting rope 32 wound around the winch drum 361. Further, since the position of a current row of the hoisting rope 32 that is wound or unwound changes slightly during one rotation, it is possible to approximately obtain how much the current row of the hoisting rope 32 is rotated, by detecting the change with the distance measurement device 629. Therefore, since the amount of movement of the hoisting rope 32 when the abrasion generation condition is satisfied can be obtained from the distance measurement device 629, the configuration can be such that the rotation amount detection device 630 is removed from the measurement unit 628.

In addition, the measurement unit 628 may have a configuration where the distance measurement device 629 is omitted.

For example, when the outer diameter of the hoisting rope 32, an outer diameter of the winding portion 362 of the winch drum 361, an interval between the two drum flanges 363, and the like are known values, current layer and row information of the hoisting rope 32 that is wound or unwound can be obtained from a total rotation amount of the winch drum 361 from a reference position (for example, the position of the winch drum 361 when the entirety of the hoisting rope 32 is unwound). Therefore, the layer and row information and an amount of movement of the hoisting rope 32 when the abrasion generation condition is satisfied can be obtained by constantly detecting the total rotation amount of the winch drum 361 with the rotation amount detection device 630, and the configuration can also be such that the distance measurement device 629 is removed from the measurement unit 628.

In addition, it is also possible to perform measurement for generation of abrasion without relying on both the distance measurement device 629 and the rotation amount detection device 630. For example, a sensor that detects whether or not the hoisting rope 32 moves to the drum flange 363 side of the winch drum 361 may be provided to detect the first row or the like.

In addition, in the embodiment, the monitoring device for the winch drum 361 of the hoisting winch 36 is provided as an example, but the winch drum of the derricking winch 42 may also be provided with a monitoring device having the same configuration.

In addition, in the embodiment, an example is provided in which the monitoring device is provided in the winch drum of the crawler crane, but is not limited to being provided in the crawler crane, and is applicable to any crane including a winch drum, such as a port crane, an overhead crane, a jib crane, a portal crane, an unloader, or a fixed crane, in addition to other mobile cranes such as a wheel crane and a truck crane.

In addition, the present invention is not limited to a crane including a suspended load hook, and a crane that suspends an attachment such as a magnet or an earth drill bucket is an application target of the present invention.

In addition, in the embodiment, notification is performed based on satisfaction of the abrasion generation condition, but for example, notification may be canceled by an input from the input unit 621.

Further, when winding or unwinding in the first layer is set as the abrasion generation condition, the notification process may be canceled when a state corresponding to the abrasion generation condition is removed.

In addition, it has been mentioned that the condition where the total amount of the flange adjacent movement amount is more than the threshold may be set as the abrasion generation condition, but in this case, once the total amount is more than the threshold, the removal of the state corresponding to the abrasion generation condition is difficult. On the other hand, for example, when a winding or unwinding state in the first row is removed, the notification process may be released. In that case, the notification process may be restarted when the winding or unwinding state in the first row is generated again.

In addition, the transmission processing unit 612 can accumulate and record an integrated value of an execution time of the notification as operation information of the crane 1, and output the integrated value to the outside, but regarding the execution time of the notification, a total time corresponding to the abrasion generation condition may be integrated, or a time where the notification is performed (time where winding or unwinding in the first row is performed) may be integrated.

It should be understood that the invention is not limited to the above-described embodiment, but may be modified into various forms on the basis of the spirit of the invention. Additionally, the modifications are included in the scope of the invention.

What is claimed is:

1. A monitoring device for a winch drum of a crane, the device comprising:

a monitoring unit that monitors whether or not an abrasion generation condition where generation of abrasion is expected for the winch drum is satisfied; and a notification unit that performs notification based on satisfaction of the abrasion generation condition.

2. The monitoring device for a winch drum according to claim 1, further comprising:

a transmission processing unit that transmits and outputs operation information of the crane to an outside.

3. The monitoring device for a winch drum according to claim 2, wherein the transmission processing unit outputs the operation information to the outside in a daily cycle.

4. The monitoring device for a winch drum according to claim 1, wherein the monitoring unit monitors a layer and row state of a wire rope wound around the winch drum.

5. The monitoring device for a winch drum according to claim 4, wherein the monitoring unit determines whether or not the wire rope is wound or unwound around the winch drum in a first layer, from the layer and row state.

6. The monitoring device for a winch drum according to claim 1, wherein the abrasion generation condition includes a condition that is satisfied when a first layer of a wire rope wound around the winch drum is used.

7. The monitoring device for a winch drum according to claim 1, wherein operation information of the crane during a period where the abrasion generation condition is satisfied is accumulated.

8. The monitoring device for a winch drum according to claim 7, wherein the operation information of the crane is divided into a plurality of sections, and information regarding the abrasion generation condition is accumulated for each section of the operation information.

9. The monitoring device for a winch drum according to claim 8, wherein the winch drum includes a winding portion around which a wire rope is wound, and drum flanges provided at both ends of the winding portion to extend in a radial direction, the abrasion generation condition is a condition related to a flange adjacent movement amount that is an amount of movement by which the wire rope moves in a position adjacent to the drum flange, and load information regarding a load acting on the wire rope is divided into a plurality of sections, and the flange adjacent movement amount is accumulated for each section of the load information.

10. The monitoring device for a winch drum according to claim 1, wherein the notification unit displays an indication of satisfaction of the abrasion generation condition, together with a layer and row display indicating a layer and a row where an unwound portion of a wire rope wound around the winch drum is located.

11. A monitoring device for a winch drum of a crane, the device comprising:

a monitoring unit that monitors whether or not an abrasion generation condition is satisfied for the winch drum; and a notification unit that performs notification based on satisfaction of the abrasion generation condition, wherein the winch drum includes a winding portion around which a wire rope is wound, and drum flanges provided at both ends of the winding portion to extend in a radial direction, and the abrasion generation condition is a condition related to a flange adjacent movement amount that is an amount of movement by which the wire rope moves in a position adjacent to the drum flange.

12. The monitoring device for a winch drum according to claim 11, wherein the wire rope is sequentially wound around the winding portion from one drum flange side to the other drum flange side, and winding is repeated such that the wire rope is layered, to form layers.

13. A monitoring device for a winch drum of a crane, the device comprising:

a monitoring unit that monitors whether or not an abrasion generation condition is satisfied for the winch drum; and a notification unit that performs notification based on satisfaction of the abrasion generation condition, wherein the notification unit displays an indication of satisfaction of the abrasion generation condition, together with a layer and row display indicating a layer and a row where an unwound portion of a wire rope wound around the winch drum is located, and when the unwound portion of the wire rope is located in a first layer, the notification unit displays an indication of the unwound portion being located in the first layer, separately from the layer and row display.

* * * * *